US009410417B2

(12) United States Patent
Reckmann et al.

(10) Patent No.: US 9,410,417 B2
(45) Date of Patent: Aug. 9, 2016

(54) DRILLING CONTROL SYSTEM AND METHOD

(75) Inventors: Hanno Reckmann, Nienhagen (DE); Bernhard Meyer-Heye, Bremen (DE); Tristan Lippert, Celle (DE); Christian Herbig, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 781 days.

(21) Appl. No.: 13/293,725

(22) Filed: Nov. 10, 2011

(65) Prior Publication Data

US 2012/0255778 A1 Oct. 11, 2012

Related U.S. Application Data

(60) Provisional application No. 61/411,968, filed on Nov. 10, 2010.

(51) Int. Cl.
*E21B 44/04* (2006.01)
*E21B 47/00* (2012.01)

(52) U.S. Cl.
CPC ..... *E21B 44/04* (2013.01); *E21B 47/0006* (2013.01)

(58) Field of Classification Search
USPC ..... 175/40, 26
See application file for complete search history.

(56) References Cited

U.S. PATENT DOCUMENTS

| | | | | |
|---|---|---|---|---|
| 4,554,819 | A | 11/1985 | Ali | |
| 5,117,926 | A | 6/1992 | Worrall et al. | |
| 5,216,917 | A * | 6/1993 | Detournay | 73/152.59 |
| 5,507,353 | A | 4/1996 | Pavone | |
| 8,622,153 | B2 * | 1/2014 | Mcloughlin et al. | 175/325.5 |
| 2006/0000643 | A1 | 1/2006 | Jenkins | |
| 2007/0289373 | A1 | 12/2007 | Sugiura | |
| 2009/0090555 | A1 * | 4/2009 | Boone et al. | 175/45 |
| 2012/0217067 | A1 * | 8/2012 | Mebane et al. | 175/57 |

OTHER PUBLICATIONS

International Search Report PCT/US2011/060167 filing date Nov. 10, 2011, mailed Aug. 29, 2012, 12 pages.

Ledgerwood, L.W., Jr.; "Efforts to Develop Improved Oilwell Drilling Methods"; Journal of Petroleum Technology; vol. 12, No. 4; p. 61-74; Apr. 1960.

* cited by examiner

*Primary Examiner* — Giovanna C Wright
(74) *Attorney, Agent, or Firm* — Cantor Colburn LLP

(57) ABSTRACT

A method of operating a drill string includes receiving signals indicative of rotation of a bottom hole assembly (BHA) of the drill string; receiving signals indicative of the torque experience by the BHA; determining from the received signals an average slipping torque and a maximum sticking torque; determining a friction ratio based on the maximum sticking torque and the average slipping torque; and generating an indication that the friction ratio exceeds a limit.

18 Claims, 3 Drawing Sheets

DRILLING CONTROL SYSTEM AND METHOD

CROSS-REFERENCE TO RELATED APPLICATIONS AND PRIORITY CLAIM

This application claims the benefit of U.S. Provisional Application Ser. No. 61/411,968, entitled "DRILLING CONTROL SYSTEM AND METHOD", filed Nov. 10, 2010, under 35 U.S.C. §119(e), which is incorporated herein by reference in its entirety.

BACKGROUND

Exploration and production of hydrocarbons generally requires that a borehole be drilled deep into the earth. The borehole provides access to a geologic formation that may contain a reservoir of oil or gas or geothermal energy. The borehole is formed with a drill string that includes a drill bit at its tip. In some cases, the bit includes abrasive layers on it. For example, the bit can include polycrystalline diamond compact (PDC) cutters to shear rock with a continuous scraping motion. A drill bit having such PDC cutters on it shall be referred to herein as a "PDC bit."

PDC bits are designed for a fixed direction of rotation. Backward rotation of a bit means it is rotating in a direction opposite to the fixed direction. If a PDC bit is rotated backwards while contacting a hard surface in the borehole, tensile load is applied to its cutters. Such a tensile load can cause nearly immediate chipping of the cutters resulting in increased bit wear and reduced drilling performance.

An extreme example of such tensile loading can occur when a stick-slip condition develops. Stick-slip relates to the binding and release of the drill string while drilling and results in torsional oscillation of the drill string. During fully developed stick-slip, the bit rotation stops and starts again periodically. Elastic energy gets stored in the drill string during the "stick" phase due to the continuous surface rotation applied to the drill string. After breaking loose the bit rotates much faster than the surface rotation before it stops again. In some cases at the end of the "slip" phase the bit rotates backwards before getting stuck again. As described above backward rotation is a very disruptive motion for PDC bits and needs to be avoided in any case. Of course, such a backward rotation could also be disruptive in other contexts.

SUMMARY

According to one embodiment, a computer-based method of operating a drill string is disclosed. The method of this embodiment includes: receiving, at a computing device, signals indicative of rotations-per-minute of a bottom hole assembly (BHA) of the drill string; receiving, at the computing device, signals indicative of the torque experience by the BHA; determining from the received signals an average slipping torque and a maximum sticking torque; determining a friction ratio based on the maximum sticking torque and the average slipping torque; and generating an indication that the friction ratio exceeds a limit.

According to another embodiment, a computer program product stored on machine-readable media for preventing backward rotation of a drill bit coupled to a drill string is disclosed. The product includes machine-executable instructions causing a computing device to: determine, from received signals indicative of the rotations permit of the drill bit and received signals indicative of the torque experience at or near the drill bit, an average slipping torque and a maximum sticking torque; determine a friction ratio based on the maximum sticking torque and the average slipping torque; and generate an indication that the friction ratio exceeds a limit.

According to one embodiment, a computer-based method of designing a portion of a drill string is disclosed. The method of this embodiment includes: modeling the portion on a computing device to create a first model; determining the torsional impedance at each end of the portion based on the first model; and adjusting the first model to create a revised model until the torsional impedance of the revised model matches within a tolerance the torsional impedance of a drill string component to which the portion will be attached.

BRIEF DESCRIPTION OF THE DRAWINGS

Referring now to the drawings wherein like elements are numbered alike in the several Figures.

DETAILED DESCRIPTION

Figure 1:
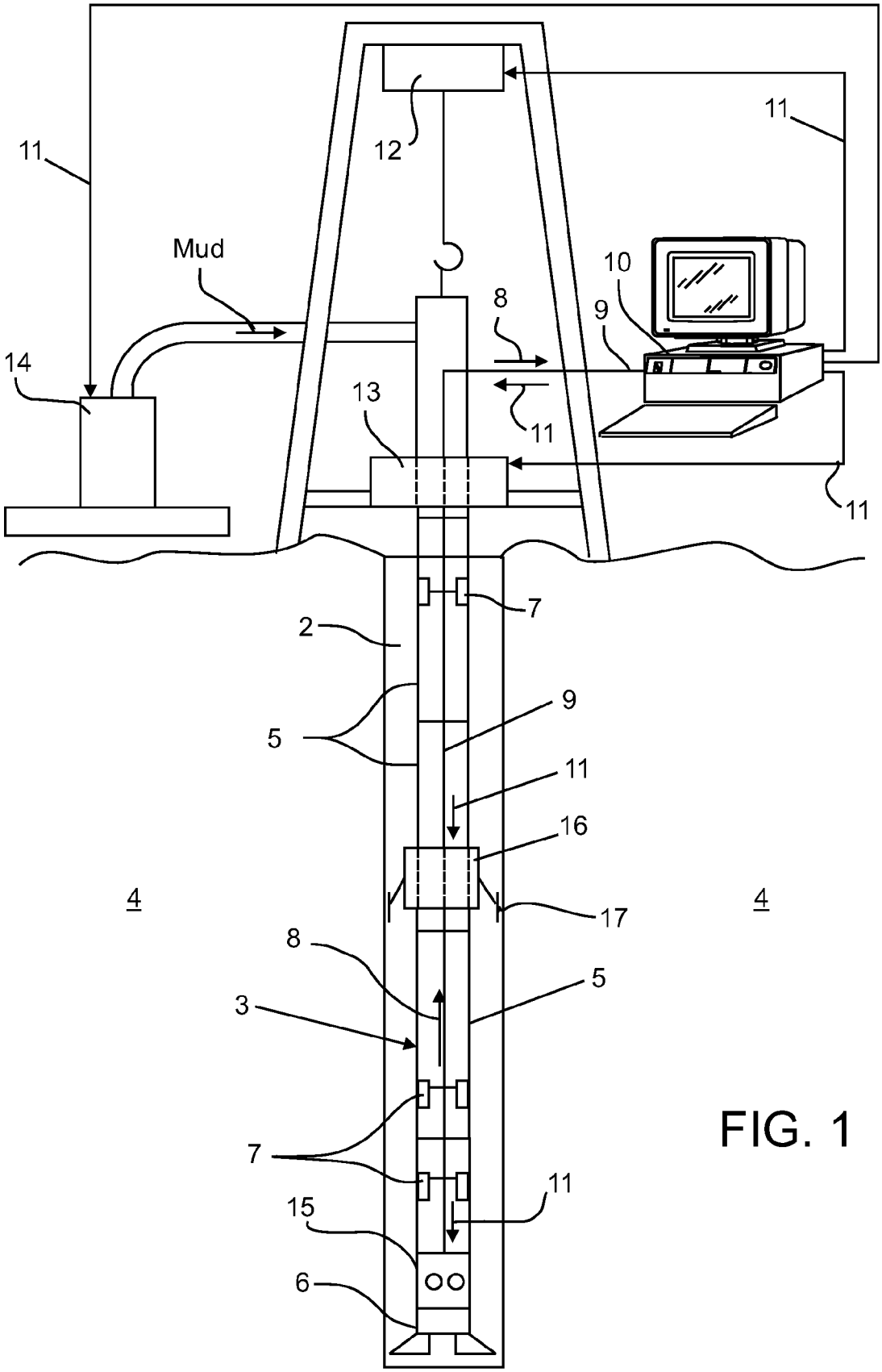
FIG. 1 illustrates an embodiment of a drill string disposed in a borehole penetrating the earth.

Embodiments of the present invention are directed to techniques to predict and, hopefully, to reduce or eliminate the occurrence of stick-slip in general and backward-rotation in particular.

For convenience, certain definitions are provided. The term "drill string" relates to at least one of drill pipe and a bottom hole assembly (BHA). In general, the drill string includes a combination of the drill pipe and a BHA. The BHA may be a drill bit, sampling apparatus, logging apparatus, or other apparatus for performing other functions downhole. As one example, the BHA can include a drill bit and a drill collar containing measurement while drilling (MWD) apparatus. In addition, in one embodiment, the drill bit can be a PDC bit.

The term "vibration" relates to oscillations or vibratory motion of the drill string. A vibration of a drill string can include at least one of axial vibration such as bounce, lateral vibration, and torsional vibration. Torsional vibration can result in the drill bit rotating at oscillating speeds when the drill string at the surface is rotating at a constant speed when, for example, stick-slip occurs. Vibration can include vibrations at a resonant frequency of the drill string. Vibration can occur at one or more frequencies and at one or more locations on the drill string. For instance, at one location on the drill string, a vibration at one frequency can occur and at another location, another vibration at another frequency can occur.

The term "sensor" relates to a device for measuring at least one parameter associated with the drill string. Non-limiting examples of types of measurements performed by a sensor include acceleration, velocity, distance, angle, force, momentum, temperature, pressure, bit RPM and vibration. As these sensors are known in the art, they are not discussed in any detail herein.

The term "controller" relates to a control device with at least a single input and at least a single output. Non-limiting examples of the type of control performed by the controller include proportional control, integral control, differential control, model reference adaptive control, model free adaptive control, observer based control, and state space control. One example of an observer based controller is a controller using an observer algorithm to estimate internal states of the drill string using input and output measurements that do not measure the internal state. In some instances, the controller can learn from the measurements obtained from the distributed control system to optimize a control strategy. The term "observable" relates to performing one or more measurements of parameters associated with the motion of the drill string wherein the measurements enable a mathematical model or an algorithm to estimate other parameters of the drill string that are not measured. The term "state" relates to a set of parameters used to describe the drill string at some moment in time.

The term "model reference adaptive control" relates to use of a model of a process to determine a control signal. The model is generally a system of equations that mathematically describe the process.

The term "drill string motivator" relates to an apparatus or system that is used to operate the drill string. Non-limiting examples of a drill string motivator include a "lift system" for supporting the drill string, a "rotary device" for rotating the drill string, a "mud pump" for pumping drilling mud through the drill string, and a "flow diverter device" for diverting a flow of mud internal to the drill string. The term "weight on bit" relates to the force imposed on the BHA and, in particular, on the drill bit. Weight on bit includes a force imposed by the lift system and an amount of force caused by the flow mud impacting on the BHA. The flow diverter and mud pump, therefore, can affect weight on bit by controlling the amount of mud impacting the bottom hole assembly.

The term "couple" relates to at least one of a direct connection and an indirect connection between two devices. The term "decoupling" relates to accounting for process interactions (static and dynamic) in a controller.

FIG. 1 illustrates an exemplary embodiment of a drill string 3 disposed in a borehole 2 penetrating the earth 4. The borehole 2 can penetrate a geologic formation that includes a reservoir of oil or gas or geothermal energy. The drill string 3 includes drill pipe 5 and a BHA 6. The bottom hole assembly 6 can include a drill bit or other drilling device for drilling the borehole 2. In one embodiment, the drill bit is a PDC bit.

In the embodiment of FIG. 1, a plurality of sensors 7 is disposed along a length of the drill string 3. The plurality of sensors 7 measures aspects related to operation of the drill string 3, such as motion of the drill string 3. A communication system 9 transmits data 8 from the sensors 7 to a controller 10. The data 8 includes measurements performed by the sensors 7. It shall be understood that in one embodiment, the data 8 can be processed before being transmitted. As such, the data 8 can include processed data or diagnostic information. Furthermore, in such an embodiment, the drill string 3 may included a processor located at or near the BHA 6 to provide such processing of the data before it is transmitted. In one embodiment, the controller 10 is configured to provide a control signal 11 to a drill string motivator. Of course, the controller 10 could also or alternatively be configured to alert an operator of the drill string of an undesirable condition.

In one embodiment, the communication system 9 can include a fiber optic or "wired pipe" for transmitting the data 8 and the control signal 11. Of course, the communication system 9 can be implemented in different ways. For example, the communication system 9 could be a mud-pulse telemetry system in one embodiment.

In one embodiment of wired pipe, the drill pipe 5 is modified to include a cable protected by a reinforced steel casing. At the end of each drill pipe 5, there is an inductive coil, which contributes to communication between two drill pipes 5. In this embodiment, the cable is used to transmit the data 8 and the control signal 11. About every 500 meters, a signal amplifier is disposed in operable communication with the cable to amplify the communication signal to account for signal loss.

One example of wired pipe is INTELLIPIPE® commercially available from Intellipipe of Provo, Utah, a division of Grant Prideco. One example of the communication system 9 using wired pipe is the INTELLISERV® NETWORK also available from Grant Prideco. The Intellisery Network has data transfer rates from fifty-seven thousand bits per second to one million bits per second or more. The communication system 9 enables sampling rates of the sensors 7 at up to 200 Hz or higher with each sample being transmitted to the controller 10 at a location remote from the sensors 7.

Various drill string motivators may be used to operate the drill string 3. The drill string motivators depicted in FIG. 1 are a lift system 12, a rotary device 13, a mud pump 14, a flow diverter 15, and an active vibration control device 16. Each of the drill string motivators depicted in FIG. 1 are coupled to the controller 10. The controller 10 can provide the control signal 11 to each of these drill string motivators to control at least one aspect of their operation. For example, the control signal 11 can cause the lift system 12 to impart a certain force on the drill string 3. The controller 10 can also control: the rotary device 13 to at least one of control the rotational speed of the drill string 3 and control the torque imposed on the drill string 3; the flow of mud from the mud pump 14; the amount of mud diverted by the flow diverter 15; and operation of the active vibration control device 16.

The example in the previous paragraph assumes automated control of the drill string 3 by the controller 10. Such automated control is not required. As such, in one embodiment, an operator is provided with a display that displays alarms and, optionally, proposed drilling parameter changes. The operator then causes the controller 10 to effect changes to the operation of the drill string 3 by manually changing set points or other parameters as is know in the art.

It has been discovered that a simple friction ratio can be utilized to predict the likelihood of backward rotation. As used herein, the friction ratio is a ratio of the maximum torque experienced during a "stick" phase to the average torque during the "slip" phase. The "stick" phase refers to a time period when a rotation sensor in or near the BHA determines that is not rotating even though a drill string motivator is providing rotational energy to the drill string. The "slip" phase refers to a time period when a rotation sensor in or near the BHA determines that the BHA is rotating. Such rotation can occur while the drill string motivator is providing rotational energy to the drill string or due to a transient condition, or both.

Figure 2:
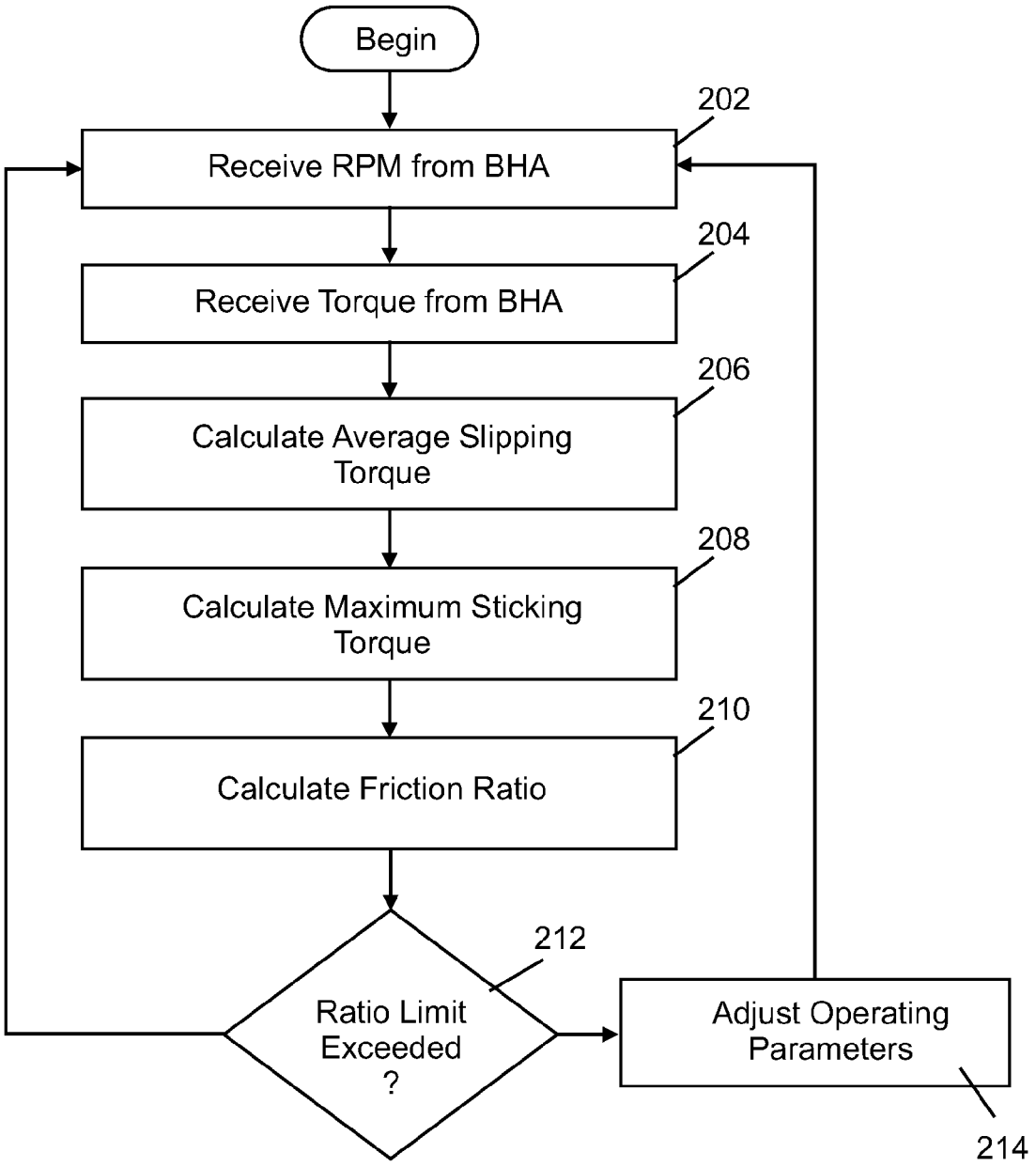
FIG. 2 is a flow chart that illustrates a method according to one embodiment.

FIG. 2 is a flow diagram illustrating a method of predicting backward rotation of bit according to one embodiment of the present invention. At block 202, one or more signals indicative of the rotations-per-minute (RPM) experienced at or near the BHA (or at or near the drill bit) are received. At block 204, one or more signals indicative of the torque of the BHA are received. In one embodiment, these values can be measured by the sensors 7 and provided to the controller 10 shown in FIG. 1. It shall be understood that in one embodiment, the torque and RPM are constantly or periodically being received. In one embodiment, the RPM and toque are received or otherwise grouped into pairs. That is, the RPM at time T1 is grouped with the torque at time T1, the RPM at time T2 is grouped with the torque at time T2 and so on.

At block 206 an average slipping torque experienced by the BHA during a slip phase is determined. The slipping torque is experienced when the RPM of the BHA is greater than 0. It shall be understood that the average torque can be time varying and based on, for example, a rolling regression or other means of calculating a current average. Furthermore, the processing during block 206 can be performed before, and during any of the other processing shown in FIG. 2.

At block 208, the maximum sticking torque is determined. In one embodiment, the maximum sticking torque is experienced when the RPM of the BHA equals zero and the drill string is being rotated at the surface. Of course, the maximum sticking torque can be selected from the received torques and can be updated whenever a new maximum is received. For instance, one embodiment, it can be understood that maximum can occur at times when the RPM of the BHA is greater than but approaching zero.

At block 210, the friction ratio is determined. As discussed above, the friction ratio is the ratio of the maximum sticking torque to the average slipping torque. At block 212 it is determined if the friction ratio exceeds a predetermined limit. If it does not, processing returns to block 202. It shall be understood that the limit can application/situation specific and may be calculated based on sensor measurements and other input like drill string components/configuration as well as survey data.

On the other hand, if the predetermined limit is exceeded, at block 214, one or more operating parameters of the drill string are adjusted to reduce the ratio below the predetermined limit. In one embodiment, adjusting can include generating a notification presented to either a controller or an individual. Regardless, the adjustment can include, in one embodiment, utilizing a model of the drill string and varying parameters thereof in a model reference adaptive control system. The control system can be included, for example, in the controller 10 (FIG. 1). The variations in parameters may include, for example, increasing or decreasing the RPM that the drill string motivator rotates the drill string or varying the weight on bit. In one embodiment, the depth of cut of the bit could be adjusted. Processing then returns to block 202.

Referring again to FIG. 1, it has further been discovered that torsional waves traveling along the drill string 3 vary the sensitivity of the drill string 3 to backward rotation of the bit. Indeed, such torsional waves can travel up and down the drill string 3 and lead to backward rotation of the bit even after the bit has become stuck. In view of this discovery, wave propagation theory can be utilized to design individual elements of the drill string 3 in a manner to reduce or minimize the potential of torsional wave reflection so that backward rotation does not occur. In particular, in one embodiment, the torsional waves impedances of adjacent pieces of the drill string 3 are matched such that the wave propagates through the junction of the two pieces rather than being reflected at the junction. In a particular embodiment, portions of drill collar are shaped such that they exhibit the same or similar torsional wave impedance as an adjacent BHA or drill pipe segment to which they will be attached.

Figure 3:
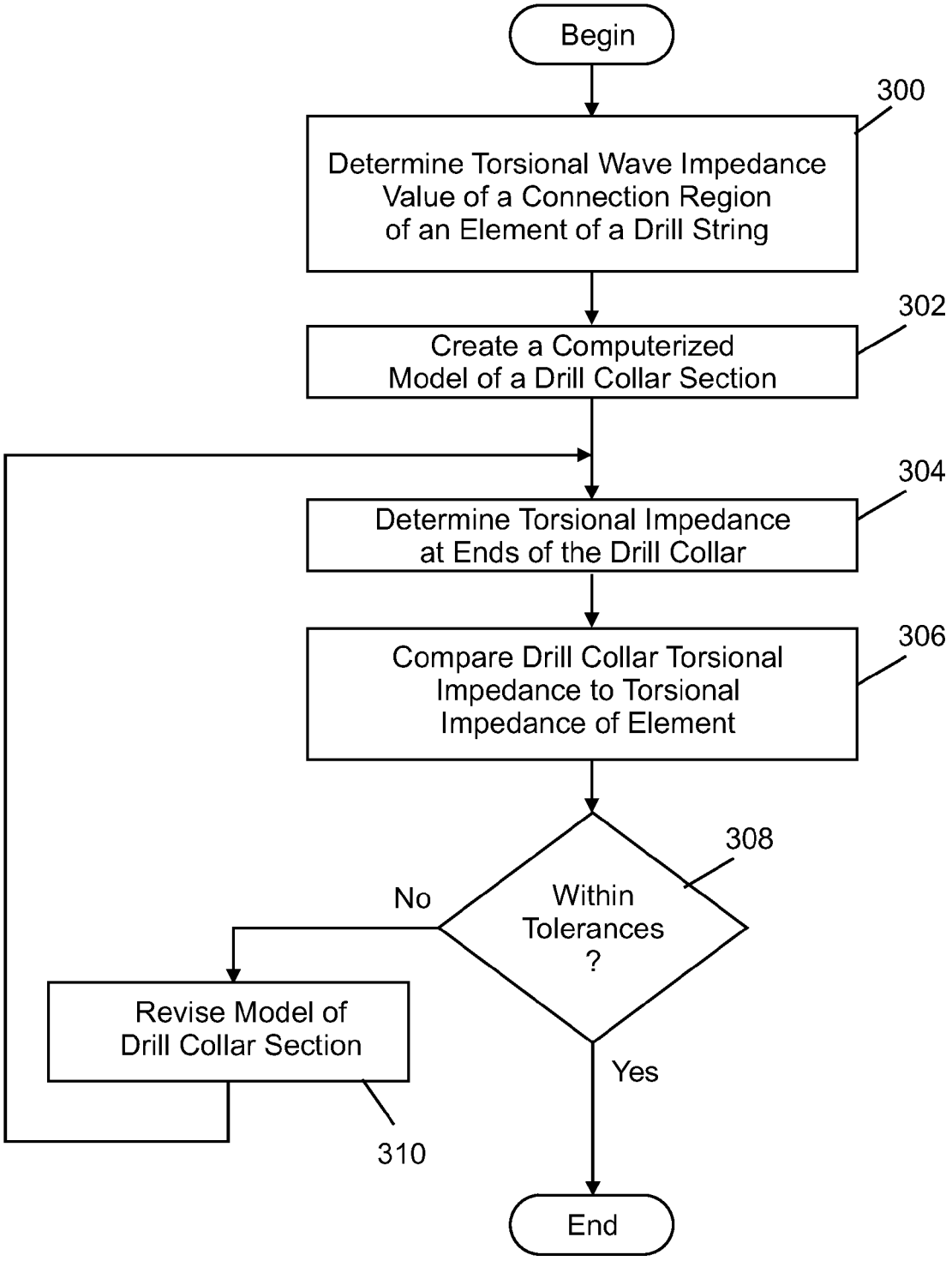
FIG. 3 is a flow chart that illustrates a method according to another embodiment.

FIG. 3 is flow diagram illustrating an embodiment of the present invention. In one embodiment, the method illustrated in FIG. 3 can be implemented on a computing device.

At block 300 a torsional wave impedance value of a connection region of an element of a drill string is determined. Such a determination can be made by physical measurements of the element or from a model (computerized of physical) of the element. The element can be, for example, a BHA or a drill pipe portion.

At block 302 a computerized model of a drill collar section is created and the torsional impedance at one or both ends thereof is determined at block 304. The computerized model of the drill collar section formed at block 302 can be created using now known or later developed element-modeling programs. Similarly, the determinations made at block 304 can be made using, for example, simulation programs that employ now known or later developed wave propagation theories and models.

At block 306 the torsional impedance at the ends of the simulated drill collar are compared to the impedance values of the element. At block 308 it is determined if the values are similar enough to be within tolerances. If so, the process ends. Otherwise, at block 310, the model of the drill collar section is revised and processing returns to block 304.

In support of the teachings herein, various analysis components may be used, including digital and/or an analog systems included in a computing device. The computing device may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, operator, owner, user or other such personnel, in addition to the functions described in this disclosure.

Further, various other components may be included and called upon for providing for aspects of the teachings herein. For example, a power supply (e.g., at least one of a generator, a remote supply and a battery), vacuum supply, pressure supply, cooling component, heating component, motive force (such as a translational force, propulsional force or a rotational force), magnet, electromagnet, sensor, electrode, transmitter, receiver, transceiver, antenna, controller, optical unit, mechanical unit (such as a shock absorber, vibration absorber, or hydraulic thruster), electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A computer-based method of operating a drill string including a drill bit, the method comprising:

measuring rotation of and torque experienced by a bottom hole assembly (BHA) of the drill string at the BHA;

receiving, at a computing device located at a surface location, signals indicative of the measured rotation and torque from the BHA;

determining from the received signals an average slipping torque and a maximum sticking torque, the signals indicative of torque being created at the drill bit;

determining a friction ratio that is equal to the maximum sticking torque divided by the average slipping torque; and adjusting one or more operating parameters of the drill string to maintain the friction ratio below a predetermined limit.

2. The method of claim 1, wherein adjusting is automatic.

3. The method of claim 1, wherein adjusting includes one of: increasing or decreasing a rotational rate of the drill bit at a surface location.

4. The method of claim 1, wherein adjusting includes one of: varying the weight on bit of the BHA or the depth of cut of a drill bit portion of the BHA.

5. The method of claim 1, wherein the operating parameter to adjust is determined by a model based control system.

6. The method of claim 1, wherein the BHA includes a drill bit having polycrystalline diamond compact (PDC) cutters.

7. The method of claim 1, wherein the signals indicative of rotation are one of: a rotational velocity or a rotation angle.

8. The method of claim 1, wherein generating includes generating an indication that a backward rotation condition may exist.

9. A non-transitory machine-readable media containing instructions for preventing backward rotation of a drill bit coupled to a drill string, the instructions causing a computing device to:

determine, from received signals measured by an RPM sensor at a bottom hole assembly (BHA) indicative of the rotations per minute of the drill bit and received signals measured by a torque sensor at the bottom hole assembly (BHA) indicative of the torque experienced at or near the drill bit, an average slipping torque and a maximum sticking torque the received signals being measured at a bottom hole assembly;

determine a friction ratio that is equal to the maximum sticking torque divided by the average slipping torque; and adjust one or more operating parameters of the drill string to maintain the friction ratio below a predetermined limit.

10. The machine-readable media of claim 9, wherein adjusting includes one of: increasing or decreasing a rotational rate of the drill string at a surface location.

11. The machine-readable media of 9, wherein adjusting includes one of: varying the weight on bit of the BHA or the depth of cut of a drill bit portion of the BHA.

12. The machine-readable media of claim 9, wherein the signals indicative of rotation are one of: a rotational velocity or a rotation angle.

13. The machine-readable media of claim 9, wherein generating includes generating an indication that a backward rotation condition may exist.

14. A computer-based method of operating a drill string including a drill bit, the method comprising:

measuring rotation of and torque experienced by a bottom hole assembly (BHA) of the drill string at the BHA;

receiving, at a computing device located at a surface location, signals indicative of the measured rotation and torque from the BHA;

determining from the received signals an average slipping torque and a maximum sticking torque, the signals indicative of torque being created at the drill bit;

determining a friction ratio that is equal to the maximum sticking torque divided by the average slipping torque; and generating an indication that the friction ratio exceeds a limit.

15. The method of claim 14, further comprising:

adjusting an operating parameter of the drill string based on the indication.

16. The method of claim 15, wherein adjusting is automatic.

17. The method of claim 15, wherein adjusting includes one of: increasing or decreasing a rotational rate of the drill bit at a surface location.

18. The method of claim 15, wherein adjusting includes one of: varying the weight on bit of the BHA or the depth of cut of a drill bit portion of the BHA.

* * * * *